US010876715B2

(12) United States Patent
Huang et al.

(10) Patent No.: US 10,876,715 B2
(45) Date of Patent: Dec. 29, 2020

(54) PANEL LIGHT FIXTURE

(71) Applicant: XIAMEN ECO LIGHTING CO. LTD., Xiamen (CN)

(72) Inventors: Zhenkun Huang, Xiamen (CN); Qiqing Yu, Xiamen (CN); Maojin Zeng, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 52 days.

(21) Appl. No.: 16/243,034

(22) Filed: Jan. 8, 2019

(65) Prior Publication Data

US 2019/0211998 A1 Jul. 11, 2019

(30) Foreign Application Priority Data

Jan. 11, 2018 (CN) ..... 2018 2 0047237 U

(51) Int. Cl.

| | |
|---|---|
| ***F21V 29/00*** | (2015.01) |
| ***F21V 17/16*** | (2006.01) |
| ***F21V 29/70*** | (2015.01) |
| ***F21V 7/04*** | (2006.01) |
| ***F21V 17/10*** | (2006.01) |
| ***F21V 23/00*** | (2015.01) |
| ***F21V 21/02*** | (2006.01) |
| *F21Y 115/10* | (2016.01) |

(52) U.S. Cl.

CPC ..... *F21V 17/162* (2013.01); *F21V 7/04* (2013.01); *F21V 7/041* (2013.01); *F21V 17/10* (2013.01); *F21V 17/101* (2013.01); *F21V 21/02* (2013.01); *F21V 23/002* (2013.01); *F21V 29/70* (2015.01); *F21Y 2115/10* (2016.08)

(58) Field of Classification Search

CPC ..... F21S 8/026; F21S 8/02; F21V 29/83

See application file for complete search history.

(56) References Cited

U.S. PATENT DOCUMENTS

| | | | | |
|---|---|---|---|---|
| 9,010,956 | B1 * | 4/2015 | Davis | F21V 21/14 362/147 |
| 2009/0237950 | A1 * | 9/2009 | Ying | B60Q 3/43 362/479 |
| 2016/0084491 | A1 * | 3/2016 | Boomgaarden | F21V 29/508 362/267 |
| 2018/0372284 | A1 * | 12/2018 | Danesh | F21S 8/03 |

* cited by examiner

*Primary Examiner* — Andrew J Coughlin

(74) *Attorney, Agent, or Firm* — Chun-Ming Shih; Lanway IPR Services

(57) ABSTRACT

A panel light fixture includes: a light source assembly; a heat sink attached to the light source assembly; an adaptor ring arranged to accommodate the light source assembly and the heat sink; an anchor plate, having a connection hole and a plurality of mounting holes, for mounting with a junction box; and a contact spring firmly connected to the heat sink for anchoring the anchor plate through the connection hole. The junction box is mounted to the anchor plate through the plurality of mounting holes.

17 Claims, 9 Drawing Sheets

PANEL LIGHT FIXTURE

BACKGROUND

The lighting industry is moving toward the use of Light Emitting Diodes (LED) panel light to replace relatively high energy consuming incandescent bulbs in light fixtures. A junction box is an enclosure housing electrical connections for providing a safety barrier for a connecting LED device. The junction box may be installed on ceiling or wall. Currently, most of the junction boxes designed for the panel light fixture are relatively large profile. Some junction boxes may have different sizes depending on the manufacturers of the junction boxes. Therefore, the adaptability of the conventional panel light fixture is relatively poor when the size of panel light fixture is fixed. Accordingly, providing a panel light fixture adaptive to the major junction boxes is an urgent need in the lighting field.

SUMMARY OF INVENTION

Embodiments of the present invention provide a panel light fixture. The panel light fixture comprises a light source assembly, a heat sink, an adaptor ring, an anchor plate, and a contact spring. The heat sink is attached to the light source assembly. The adaptor ring is arranged to accommodate the light source assembly and the heat sink. The anchor plate is arranged to have a connection hole and a plurality of mounting holes, for mounting with a junction box. The contact spring is firmly connected to the heat sink, for anchoring the anchor plate through the connection hole. The junction box is mounted to the anchor plate through the plurality of mounting holes.

In one embodiment, the panel light fixture further comprises a light-transmissive board and a reflective cup. The light-transmissive board, the reflective cup, the light source assembly, and the heat sink are orderly accommodated in the adaptor ring from a lower portion of the adaptor ring to an upper portion of the adaptor ring.

In one embodiment, the adaptor ring is configured to have a central opening.

In one embodiment, the plurality of mounting holes are disposed on a first side and a second side of the connection hole respectively, the plurality of mounting holes and the connection hole are aligned to a straight line, and the first side of the connection hole is opposite to the second side of the connection hole.

In one embodiment, the contact spring comprises a bottom section, a bending section, and a guiding section. The bottom section is arranged to firmly connect to the heat sink. The bending section is formed on a first end and a second end of the bottom section, wherein the bending section is arranged to bend upward from the first end and the second end of the bottom section. The guiding section is formed on a first end of the bending section, wherein a second end of the bending section is connected to the bottom section, and the guiding section is arranged to be tilted inward.

In one embodiment, the panel light fixture further comprises a press plate. The press plate is disposed on the bottom section of the contact spring, and the press plate is firmly connected to the bottom section of the contact spring and the heat sink.

In one embodiment, the panel light fixture further comprises a fastener. The fastener is arranged to fix the press plate and the contact spring on a surface of the first side of the heat sink.

In one embodiment, the panel light fixture further comprises an input line and a fixing clamp. The input line is arranged to have a first end electrically connected to the light source assembly, and a second end penetrated the heat sink. The fixing clamp is arranged to fix the input line.

In one embodiment, the panel light fixture further comprises a Mylar tape. The Mylar tape is disposed on the light source assembly.

In one embodiment, the adaptor ring comprises an annular groove. The annular groove is formed inside the adaptor ring. The panel light fixture further comprises a foaming material. The foaming material is formed in the annular groove.

In one embodiment, the panel light fixture further comprises a seal ring. The seal ring is disposed between the adaptor ring and the light-transmissive board.

In one embodiment, the seal ring comprises a circular and convex supporting rod. The circular and convex supporting rod is disposed on a side of the light-transmissive board, for making the light-transmissive board tightly contact with the seal ring.

Embodiments of the present invention provide a panel light fixture. The panel light fixture comprises an anchor plate, a junction box, a light source assembly, a heat sink, and a contact spring. The anchor plate is arranged to have a connection hole and a plurality of mounting holes. The junction box is arranged to mount to the anchor plate through the plurality of mounting holes. The light source assembly is arranged to emit optical light. The heat sink is attached to the light source assembly. The contact spring is firmly connected to the heat sink, for anchoring the anchor plate through the connection hole.

In one embodiment, the junction box is mounted to a portion of holes in the plurality of mounting holes of the anchor plate for providing a supply power for the light source assembly according to a size of the junction box.

In one embodiment, the portion of holes are symmetrical holes with respect to the mounting hole.

In one embodiment, the panel light fixture further comprises a reflective cup, a light-transmissive board, and an adaptor ring. The reflective cup is arranged to reflect the optical light. The light-transmissive board is arranged to pass the optical light. The adaptor ring is arranged to orderly accommodate the light-transmissive board, the reflective cup, the light source assembly, and the heat sink from a lower portion of the adaptor ring to an upper portion of the adaptor ring.

In one embodiment, the plurality of mounting holes are disposed on a first side and a second side of the connection hole respectively, the plurality of mounting holes and the connection hole are aligned to a straight line, and the first side of the connection hole is opposite to the second side of the connection hole.

In one embodiment, the contact spring comprises a bottom section, a bending section, and a guiding section. The bottom section is arranged to firmly connect to the heat sink. The bending section is formed on a first end and a second end of the bottom section, wherein the bending section is arranged to bend upward from the first end and the second end of the bottom section. The guiding section is formed on a first end of the bending section, wherein a second end of the bending section is connected to the bottom section, and the guiding section is arranged to be tilted inward.

In one embodiment, the bending section and the guiding section are arranged to mount into the connection hole of the anchor plate.

In one embodiment, the panel light fixture further comprises a press plate. The press plate is disposed on the bottom section of the contact spring, the press plate firmly connected to the bottom section of the contact spring and the heat sink to enhance a strength the contact spring.

BRIEF DESCRIPTION OF DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
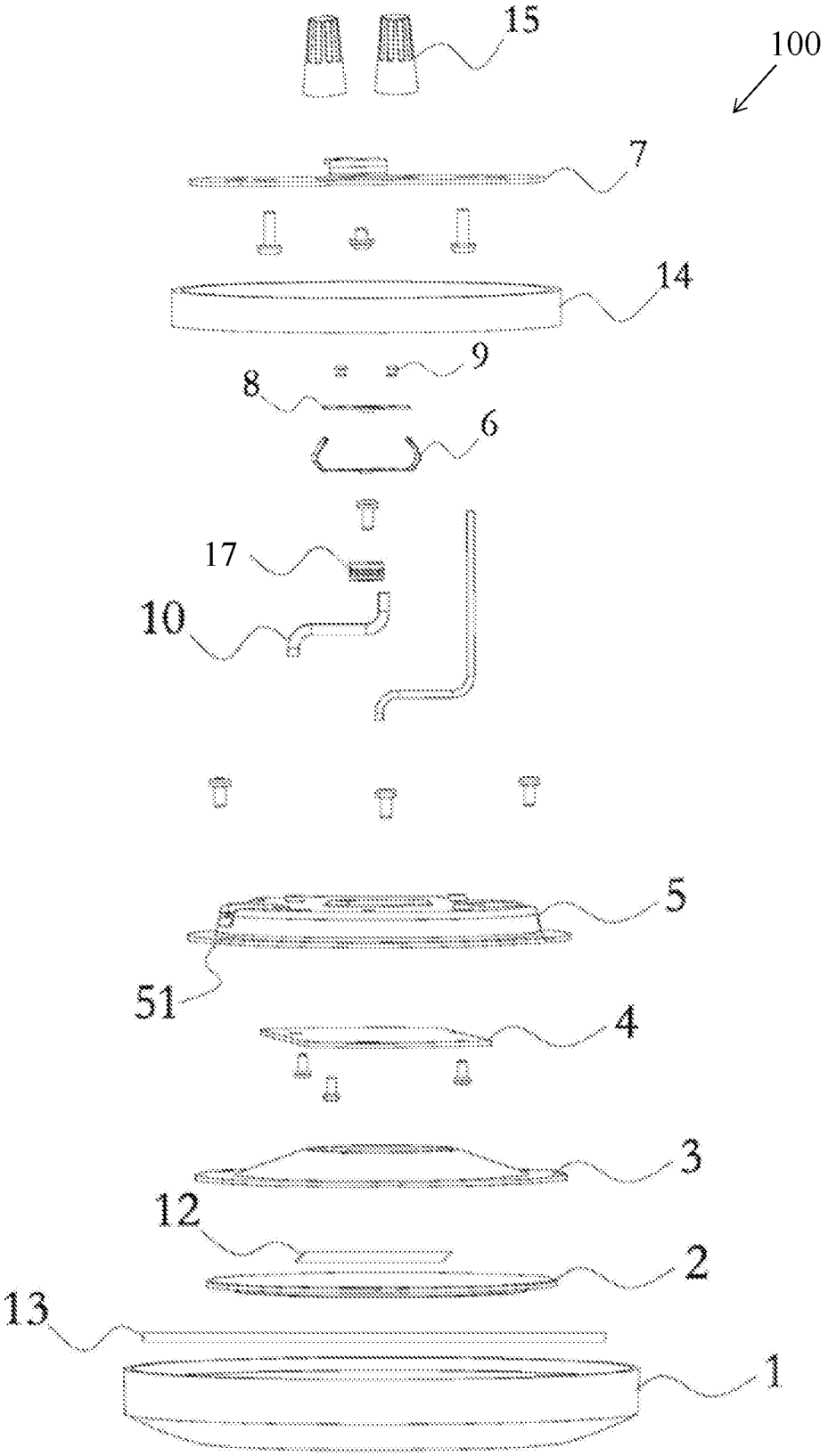
FIG. 1 is a diagram illustrating an exploded view of a panel light fixture in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in the respective testing measurements. Also, as used herein, the term "about" generally means within 10%, 5%, 1%, or 0.5% of a given value or range. Alternatively, the term "about" means within an acceptable standard error of the mean when considered by one of ordinary skill in the art. Other than in the operating/working examples, or unless otherwise expressly specified, all of the numerical ranges, amounts, values and percentages such as those for quantities of materials, durations of times, temperatures, operating conditions, ratios of amounts, and the likes thereof disclosed herein should be understood as modified in all instances by the term "about." Accordingly, unless indicated to the contrary, the numerical parameters set forth in the present disclosure and attached claims are approximations that can vary as desired. At the very least, each numerical parameter should at least be construed in light of the number of reported significant digits and by applying ordinary rounding techniques. Ranges can be expressed herein as from one end point to another end point or between two end points. All ranges disclosed herein are inclusive of the end points, unless specified otherwise.

Figure 4:
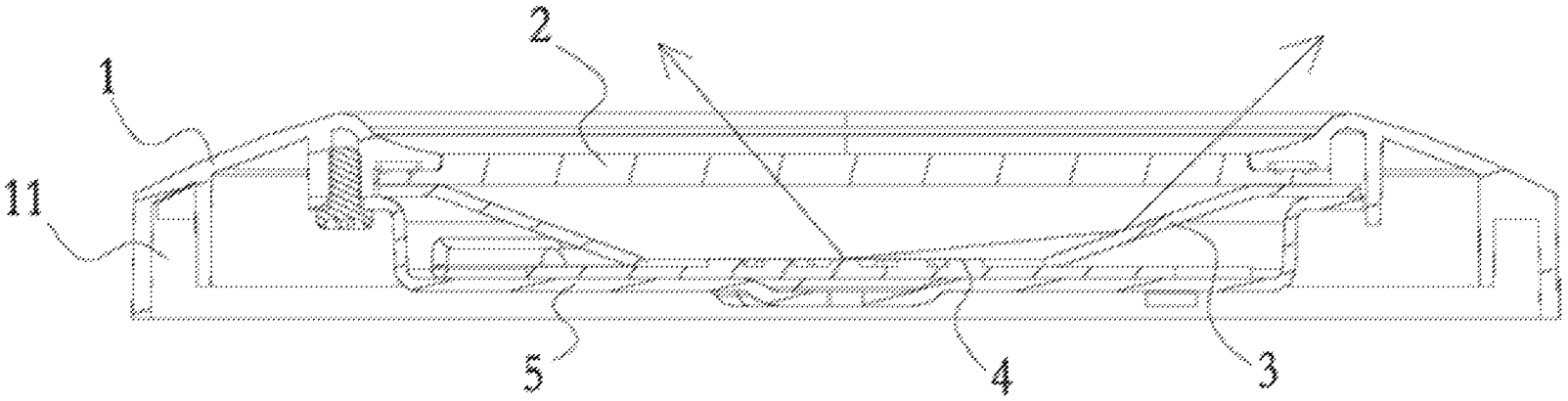
FIG. 4 is a diagram illustrating a cross-sectional view of the panel light fixture of FIG. 2 in accordance with some embodiments.

FIG. 1 is a diagram illustrating an exploded view of a panel light fixture 100 in accordance with some embodiments. The panel light fixture 100 may be a Light Emitting Diodes (LED) lighting device. However, this is not a limitation of the present invention. According to the embodiment as shown in FIG. 1, the panel light fixture 100 comprises an adaptor ring 1, a light-transmissive board 2, a reflective cup 3, a light source assembly 4, a heat sink 5, a contact spring 6, an anchor plate 7, a press plate 8, at least one rivet 9, an input line 10, a fixing clamp 17, a Mylar tape 12, a seal ring 13, a foaming material 14, and a wire nut 15. However, this is not a limitation of the present invention. In an embodiment, the panel light fixture 100 may comprise an adaptor ring 1, the light-transmissive board 2, the reflective cup 3, the light source assembly 4, the heat sink 5, the contact spring 6, and the anchor plate 7. The light source assembly 4 is arranged to emit optical light, e.g. the arrows as shown in FIG. 4. The reflective cup 3 is arranged to reflect the optical light such that the optical light may condense to a predetermined or fixed direction or a predetermined angle range. The light-transmissive board 2 is arranged to pass the optical light. The light-transmissive board 2 may be a transparent or semi-transparent board. The adaptor ring 1 is configured to have a central opening. The size of the central opening may be adapted to the size of the light-transmissive board 2. For example, the size of the central opening may be slightly smaller than the size of the light-transmissive board 2 such that the light-transmissive board 2 may be supported by the edge of the central opening. According to some embodiments, the light-transmissive board 2, the reflective cup 3, the light source assembly 4, and the heat sink 5 are orderly accommodated or contained in the adaptor ring 1 from a lower portion of the adaptor ring 1 to an upper portion of adaptor ring 1. The lower portion may be the bottom portion of the adaptor ring 1, and the upper portion may be the top portion of the adaptor ring 1. The contact spring 6 is firmly connected to a first side of the heat sink 5, wherein a second side of the heat sink 5 is connected to the light source assembly 4. The first side of the heat sink 5 may be the top side of the heat sink 5, and the second side of the heat sink 5 may be to bottom side of the heat sink 5.

Figure 2:
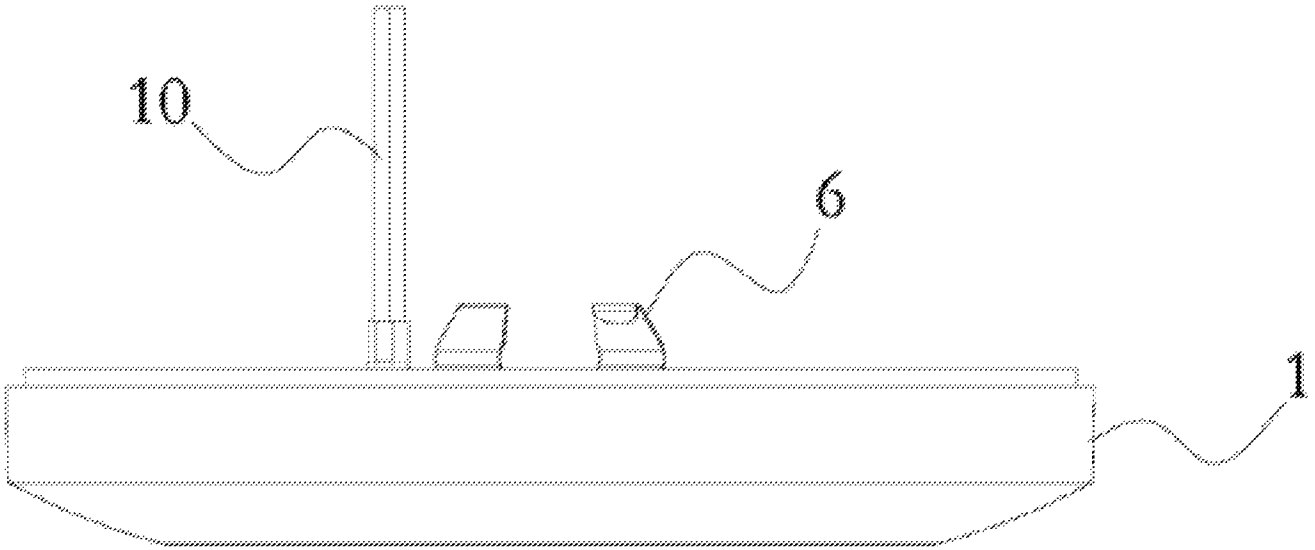
FIG. 2 is a diagram illustrating a side view of the panel light fixture in accordance with some embodiments.

FIG. 2 is a diagram illustrating a side view of the panel light fixture in accordance with some embodiments. According to the embodiment as shown in FIG. 2, the light-transmissive board 2, the reflective cup 3, the light source assembly 4, the heat sink 5, the contact spring 6, the press plate 8, the rivet 9, the input line 10, the fixing clamp 17, the Mylar tape 12, the seal ring 13, and the foaming material 14 are accommodated or installed in the adaptor ring 1. The bending section and the guiding section of the contact spring 6 are arranged to protrude from a surface (e.g. the top surface) of the adaptor ring 1. The input line 10 is a wire line having a terminal extending long enough to connect with the wire line of the junction box.

Figure 3:
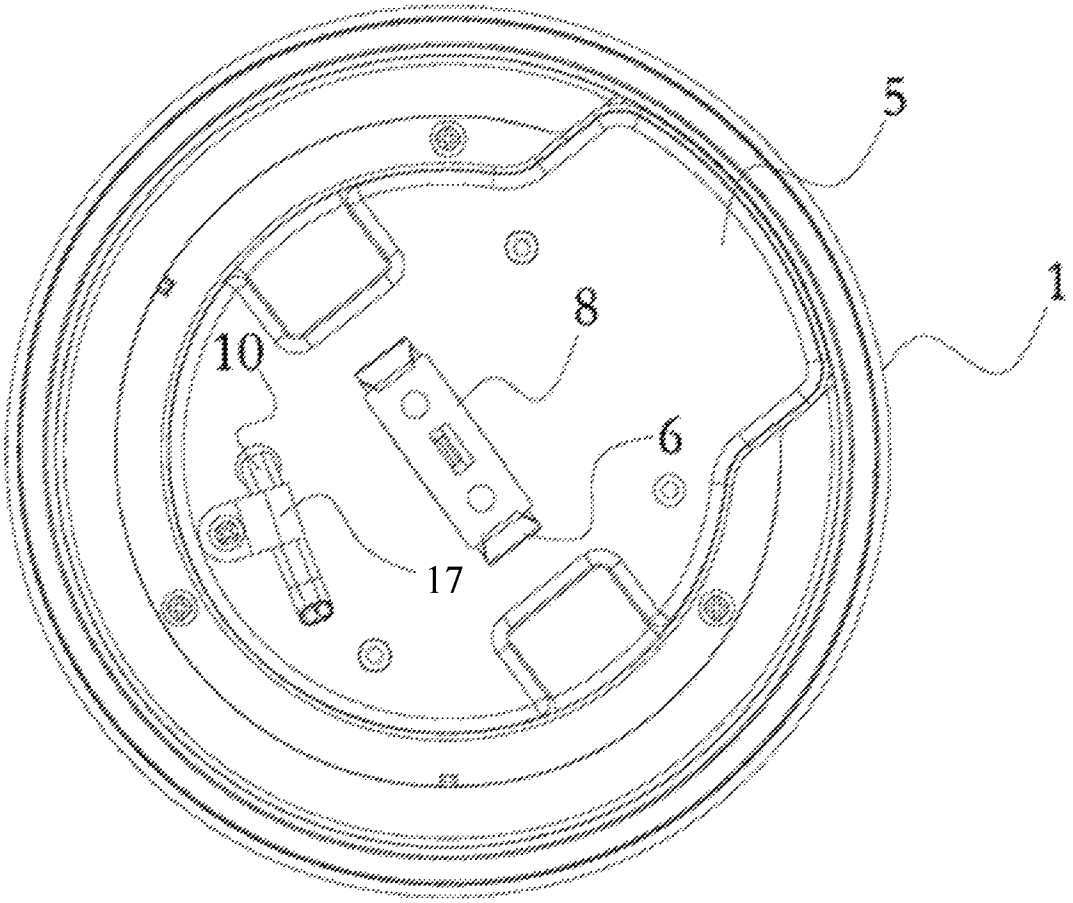
FIG. 3 is a diagram illustrating a top view of the panel light fixture of FIG. 2 in accordance with some embodiments.

FIG. 3 is a diagram illustrating a top view of the panel light fixture of FIG. 2 in accordance with some embodiments. Viewing from the top, merely the heat sink 5, the contact spring 6, the press plate 8, the input line 10, the fixing clamp 17, and the adaptor ring 1 are shown. The fixing clamp 17 is arranged to clamp the input line 10 on the surface of the heat sink 5. The press plate 8 is firmed mounted on the bottom section of the contact spring 6 to enhance or increase the strength of the contact spring such that the contact spring 6 may support heavy weight of the panel light fixture on the ceiling.

FIG. 4 is a diagram illustrating a cross-sectional view of the panel light fixture of FIG. 2 in accordance with some embodiments. It is noted that the cross-sectional view of the panel light fixture in FIG. 4 is upside down in comparison to the diagram of FIG. 2. In FIG. 4, the adaptor ring 1, the light-transmissive board 2, the reflective cup 3, the light source assembly 4, and the heat sink 5 are shown. According to some embodiments, the light-transmissive board 2 is supported by the protruding edge of the central opening of the adaptor ring 1. The reflective cup 3 is attached on the light-transmissive board 2. According to some embodiments, the reflective cup 3 may be firmly fixed or gripped on the light-transmissive board 2. The reflective cup 3 is designed to have a central opening. The light source assembly 4 is formed on the reflective cup 3. More specifically, the light source assembly 4 is supported by the edge of the central opening of the reflective cup 3. According to some embodiments, the light source assembly 4 may be firmly fixed or gripped on the edge of the central opening of the reflective cup 3. The light source assembly 4 may comprise a plurality of LED units and a circuit board. The plurality of LED units are formed on the circuit board for generating the optical light. The reflective cup 3 is arranged to reflect the optical light such that the optical light (i.e. the arrows) may condense to a predetermined or fixed direction or a predetermined angle range. In addition, the heat sink 5 is arranged to attach or dispose on the light source assembly 4 for dissipating the heat generated by the light source assembly 4 during the operation. In this embodiment, one side of the foot of the heat sink 5 is firmly screwed by a screw on the adaptor ring 1, and the other side of the foot of the heat sink 5 is arranged to grip the reflective cup 3 on the light-transmissive board 2.

Figure 5:
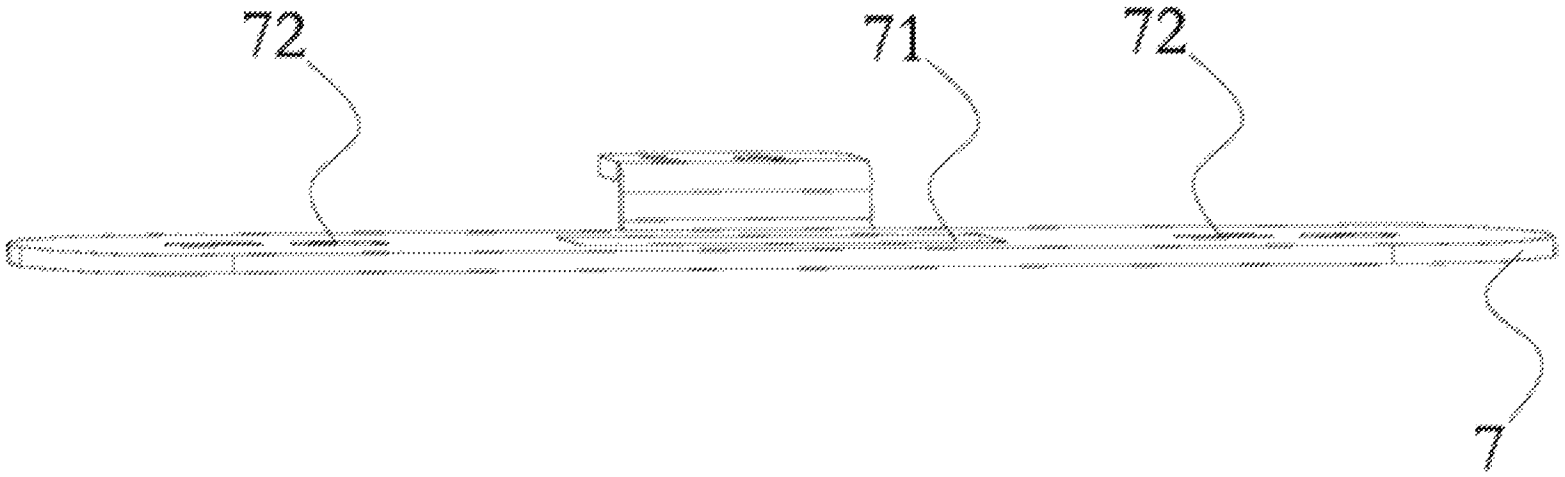
FIG. 5 is a diagram illustrating an anchor plate in accordance with some embodiments.

FIG. 5 is a diagram illustrating the anchor plate 7 in accordance with some embodiments. According to some embodiments, the anchor plate 7 is arranged to firmly connect with a junction box (not shown). According to some embodiments, the junction box is arranged to provide a supply power for the light source assembly 4. Therefore, the junction box may be an enclosure housing electrical connections on the ceiling or a wall for providing a safety barrier for the presented panel light fixture 100. In practice, the junction boxes may have different sizes. When the anchor plate 7 is mounted to a junction box, a panel light fixture (e.g. the panel light fixture of FIG. 2) may connect to the junction box through the anchor plate 7. In this embodiment, the anchor plate 7 comprises a connection hole 71 and a plurality of mounting holes 72. The connection hole 71 may be formed in the center of the anchor plate 7. The plurality of mounting holes 72 may be formed on the sides of the anchor plate 7. In this embodiment, the plurality of mounting holes 72 may be formed on the opposite sides of the connection hole 71 on the anchor plate 7. The connection hole 71 is used for anchoring the contact spring 6. When the contact spring 6 is plugged or inserted into the connection hole 7, the contact spring 6 may be clamped by the connection hole 71 such that the panel light fixture 100 may be lifted by the anchor plated 7 or the junction box. The plurality of mounting holes 72 are arranged for being mounted by the junction box. As mentioned above, the junction boxes may have different sizes depending on the manufacturers of the junction boxes. In this embodiment, the plurality of mounting holes 72 on the anchor plate 7 is designed to adapt for the junction boxes with different sizes. In other words, a junction box may be mounted to a portion of holes in the plurality of mounting holes 72 of the anchor plate 7 according to the size of the junction box. For the example of FIG. 5, when the size of the junction box is relatively small, the junction box may be mounted to the two inner mounting holes 72 of the anchor plate 7, and the two outer mounting holes 72 are kept intact. When the size of the junction box is relatively large, the junction box may be mounted to the two outer mounting holes 72 of the anchor plate 7, and the two inner mounting holes 72 are kept intact.

It is noted that, according to the embodiments, the anchor plate 7 may be designed to have an appropriate number of the mounting holes 72 based on the system requirement. For example, the number of the mounting holes 72 may be 2, 4, or 6. Moreover, the mounting holes 72 may be formed on appropriate positions in order to adapt to the junction boxes with different sizes.

According to an embodiment of the panel light fixture 100, the contact spring 6 is arranged to firmly connect to the first side (or the top side) of the heat sink 5, i.e. the contact spring 6 is opposite to the light source assembly 4 with respect to the heat sink 5. The anchor plate 7 having the connection hole 71 and the plurality of mounting holes 72 is arranged to connect the junction box, wherein the connection hole 71 is arranged to anchor the contact spring 6, and the plurality of mounting holes 72 are arranged to be mounted with the junction box. When the plurality of mounting holes 72 are mounted with the junction box, the panel light fixture 100 may be installed or mounted to the junction box via the anchor plate 7. As mentioned above, due to the plurality of mounting holes 72 on the anchor plate 7, the panel light fixture 100 may be adapted to junction boxes with different sizes. As a junction box may be mounted to a portion of holes (e.g. two holes) of the plurality of mounting holes 72 based on the size of the junction box, the adaptability of the panel light fixture 100 is improved. In addition, as shown by the arrows, which are the direction of light path of the panel light fixture 100, in FIG. 4, the light generated by the panel light fixture 100 may be condensed on the area below or above the panel light fixture 100. Therefore, the panel light fixture 100 may be installed on a ceiling with relatively low ceiling height. Moreover, the space required for the installation of the panel light fixture 100 is relatively small, and the cost of installing the panel light fixture 100 is also reduced.

In addition, according to an embodiment of the panel light fixture 100, the light source assembly 4 may comprise a circuit board and an LED light source having a plurality of LED units, in which the LED light source is disposed on the circuit board. According to some embodiments, the light source assembly 4 is fixed on the heat sink 5 via at least one screw. The reflective cup 3 and the light-transmissive board 2 are firmly fixed on the adaptor ring 1 by using the screw(s) on the heat sink 5. Moreover, the outer edge or the foot of the heat sink 5 is designed to have a groove(s) 51 or a hole(s), in which the screw(s) may penetrate the groove(s) 51 such that the reflective cup 3 and the light-transmissive board 2 may firmly fix on the adaptor ring 1. Further, the anchor plate 7 is firmly connected to the junction box through at least one screw and the wire nut 15.

In addition, according to an embodiment of the panel light fixture 100, the plurality of mounting holes 72 are formed on the anchor plate 7. In the embodiment of FIG. 5, two mounting holes are formed on a first side and a second side of the connection hole 71 on the anchor plate 7, i.e. a total of four mounting holes 72 are formed on the anchor plate 7. The first side of the connection hole 71 is opposite to the second side of the connection hole 71. Moreover, the four mounting holes 72 and the connection hole 71 are aligned to a straight line. The two mounting holes 72 on the first side and the two mounting holes 72 on the second side are symmetrically disposed on the anchor plate 7 with respect to the connection hole 71. Therefore, there have two group of mounting holes 72 disposed on the anchor plate 7. Each group comprises two mounting holes 72. One mounting hole 72 in a group is symmetric to the other mounting hole 72 in the group with respect to the connection hole 71. When the panel light fixture 100 is installed to a junction box, only one group or a portion of mounting holes 72 may be selected to be screwed depending on the size of the junction box. Accordingly, in this embodiment, the panel light fixture 100 may be adapted to two junction boxes with different sizes. Accordingly, the adaptability of the panel light fixture 100 is improved. It is noted that the present invention is not limited by this embodiment. In another embodiments, there may have six or more even number of mounting holes 72 symmetrically forming on the anchor plate 7, in which three or more mounting holes 72 may be disposed on the first side of the connection hole 71 and three or more mounting holes 72 may be disposed on the second side of the connection hole 71.

Figure 6:
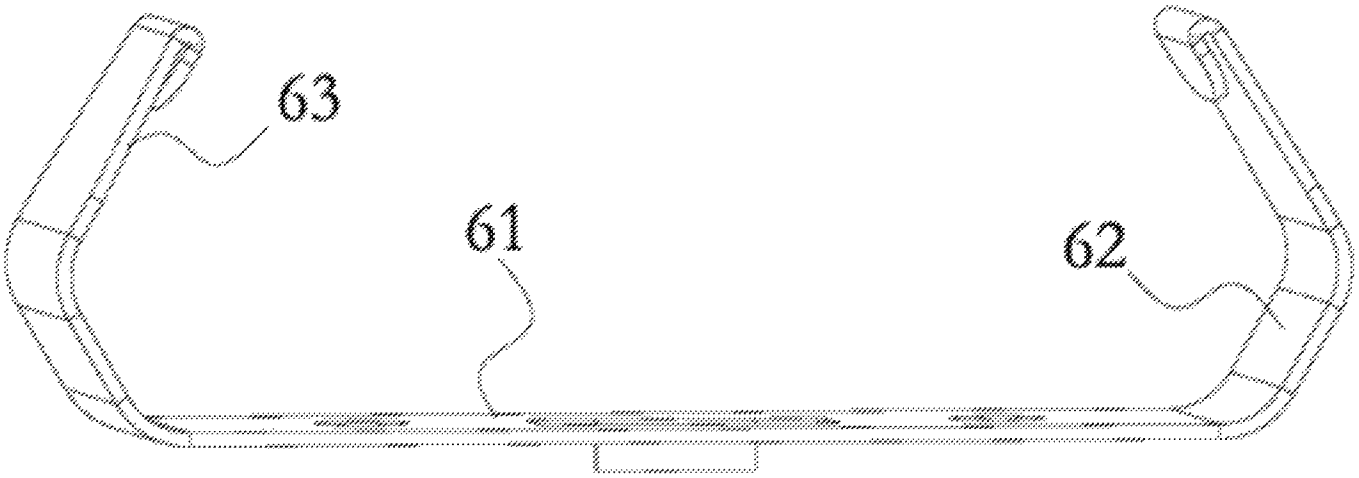
FIG. 6 is a diagram illustrating a contact spring in accordance with some embodiments.

FIG. 6 is a diagram illustrating the contact spring 6 in accordance with some embodiments. According to the embodiment of FIG. 6, the contact spring 6 comprises a bottom section 61, the bending section 62, and the guiding section 63, wherein the bottom section 61 may be a flat and square (or rectangular) plate. The bottom section 61 is arranged to firmly connect or attach to the heat sink 5. The bending sections 62 are formed on a first end and a second end of the bottom section 61 respectively, wherein the bending sections 62 are arranged to bend upward from the first end and the second end of the bottom section 61 respectively. The guiding sections 63 are formed on the first ends of the bending sections 62 respectively, wherein the second ends of the bending sections 62 are connected to the bottom section 61, and the guiding sections 63 are arranged to be tilted inward. According to some embodiments, the guiding section 63 is arranged to guide the contact spring 6 to plug into the connection hole 71. In this embodiment, the shape of the connection hole 71 is square. However, this is not a limitation of the present invention. In another embodiment, the shape of the connection hole 71 may be rectangular. In addition, the contact spring 6 is a one-piece device, i.e. the bottom section 61, the bending section 62, and the guiding section 63 are formed integrally. However, this is also not a limitation of the present invention.

In addition, according to an embodiment of the panel light fixture 100, the panel light fixture 100 further comprises the press plate 8. As shown in FIG. 1 and FIG. 3, the press plate 8 is disposed on the bottom section 61 of the contact spring 6. The press plate 8 is firmly connected to the bottom section 61 of the contact spring 6 and the heat sink 5. According to some embodiments, the shape of the press plate 8 is designed to match with the shape of bottom section 61. More specifically, the press plate 8 is arranged to enhance the strength of the contact spring 6 such that the contact spring 6 may support the lighting device with the weight of at least 44.5 N (10 lbs.), which is the safety specifications of United State of America.

In addition, according to an embodiment of the panel light fixture 100, a fastener (e.g. the rivets 9 as shown in FIG. 1) is arranged to fix the press plate 8 and the contact spring 6 on a surface of a side (e.g. the first side) of the heat sink 5. According to this embodiment, at least one rivet 9 is used to rivet the press plate 8 and the contact spring 6 on the heat sink 5.

In addition, according to an embodiment of the panel light fixture 100, the panel light fixture 100 further comprises the input line 10 and the fixing clamp 17 as shown in FIG. 1. The input line 10 has a first end electrically connected to the light source assembly 4 and a second end penetrated the heat sink 5. The fixing clamp 17 is arranged to fix or clamp the input line 10 on the heat sink 5. More specifically, the fixing clamp 17 is arranged to clamp the input line 10 such that the input line 10 may be fixed on a specific direction on the heat sink 5. In addition, a screw is used to firmly screw the fixing clamp 17 on the heat sink 5.

In addition, according to an embodiment of the panel light fixture 100, the panel light fixture 100 further comprises a Mylar tape 12 as shown in FIG. 1. The Mylar tape 12 is disposed or pasted on the light source assembly 4. In this embodiment, the Mylar tape 12 is used to mitigate the ionization of the circuit board. In other words, the Mylar tape 12 provide electrical clearance of about 5 mm for the circuit board such that the circuit board conform to the safety specifications of the lighting system.

In addition, according to an embodiment of the panel light fixture 100, the panel light fixture 100 further comprises a seal ring 13 as shown in FIG. 1. The seal ring 13 is disposed between the adaptor ring 1 and the light-transmissive board 2. In this embodiment, two loops of circular and convex supporting rod are disposed on a side of the light-transmissive board 2 for making the light-transmissive board 2 tightly contact with the seal ring 13. When the light-transmissive board 2 tightly contacts with the seal ring 13, the water resistance or permeability of the panel light fixture 100 is improved.

In addition, according to an embodiment of the panel light fixture 100, in FIG. 1 and FIG. 4, the adaptor ring 1 is designed to have an annular groove 11. The annular groove 11 is formed inside the adaptor ring 1. According to some embodiments, the panel light fixture 100 further comprises a foaming material 14. The foaming material 14 is formed or filled in the annular groove 11. The top or upper surface of the foaming material 14 is higher than the top or upper surface of the adaptor ring 1 such that the top or upper surface of the foaming material 14 attached on the ceiling when the panel light fixture 100 is installed on the ceiling. Accordingly, the panel light fixture 100 may be sealed on the ceiling, and the water resistance or permeability of the panel light fixture 100 is further improved.

Figure 7:
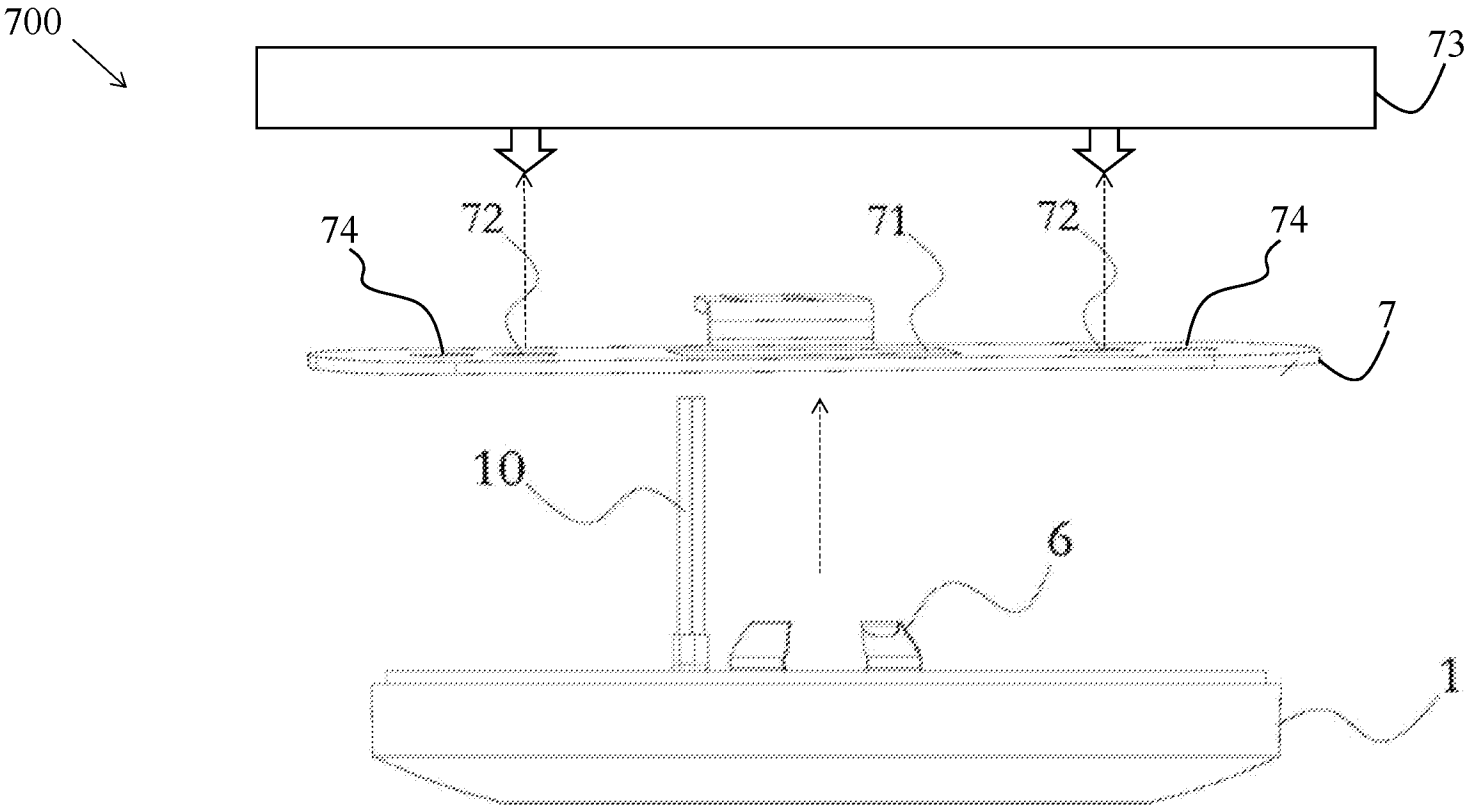
FIG. 7 is a diagram illustrating an exploded view of a panel light fixture in accordance with some embodiments.

FIG. 7 is a diagram illustrating an exploded view of a panel light fixture 700 in accordance with some embodiments. The panel light fixture 700 comprises a function box 73, the anchor plate 7, and the adaptor ring 1. In this embodiment, the light-transmissive board 2, the reflective cup 3, the light source assembly 4, the heat sink 5, the contact spring 6, the press plate 8, the rivet 9, the input line 10, the fixing clamp 17, the Mylar tape 12, the seal ring 13, and the foaming material 14 have been accommodated or installed in the adaptor ring 1. Moreover, the function box 73 is a relatively small function box. Therefore, the anchor plate 7 is mounted to the function box 73 through the two inner mounting holes 72 of the anchor plate 7, and the two outer mounting holes 74 of the anchor plate 7 are kept intact. Two screws may be used to screw the anchor plate 7 on the function box 73 through the two inner mounting holes 72 respectively. When the anchor plate 7 is mounted to the function box 73, the contact spring 6 on the adaptor ring 1 may be plugged into the connection hole 71 of the anchor plate 7 and the input line 10 may be electrically connected with the output line (not shown) of the function box 73. The output line may transmit power to the panel light fixture 700 via the input line 10.

Figure 8:
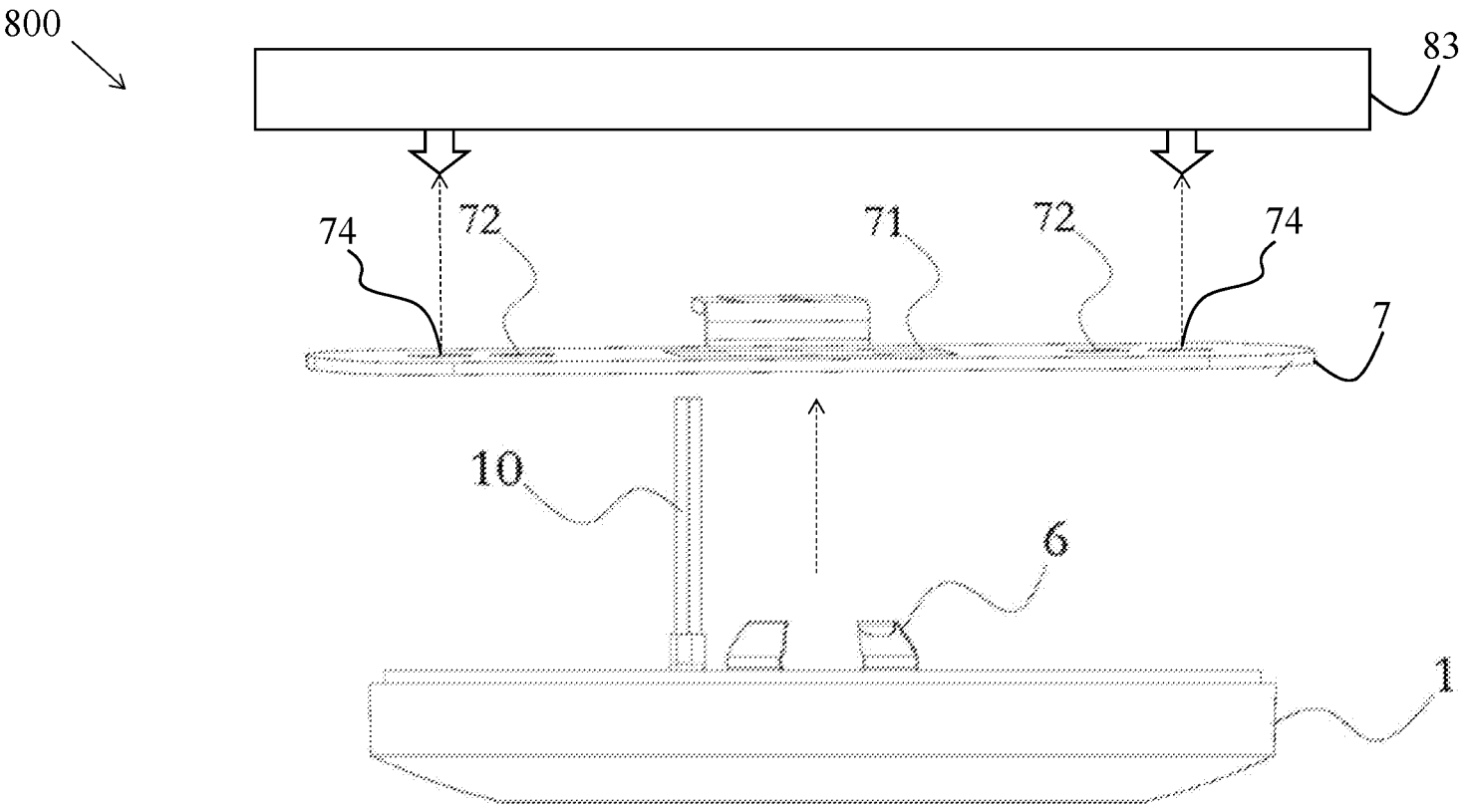
FIG. 8 is a diagram illustrating an exploded view of a panel light fixture in accordance with some embodiments.

FIG. 8 is a diagram illustrating an exploded view of a panel light fixture 800 in accordance with some embodiments. The panel light fixture 800 comprises a function box 83, the anchor plate 7, and the adaptor ring 1. In this embodiment, the light-transmissive board 2, the reflective cup 3, the light source assembly 4, the heat sink 5, the contact spring 6, the press plate 8, the rivet 9, the input line 10, the fixing clamp 17, the Mylar tape 12, the seal ring 13, and the foaming material 14 have been accommodated or installed in the adaptor ring 1. Moreover, the function box 83 is a relatively large function box in comparison to the function box 73. Therefore, the anchor plate 7 is mounted to the function box 83 through the two outer mounting holes 74 of the anchor plate 7, and the two inner mounting holes 72 of the anchor plate 7 are kept intact. Two screws may be used to screw the anchor plate 7 on the function box 83 through the two outer mounting holes 74 respectively. When the anchor plate 7 is mounted to the function box 83, the contact spring 6 on the adaptor ring 1 may be plugged into the connection hole 71 of the anchor plate 7 and the input line 10 may be electrically connected with the output line (not shown) of the function box 83. The output line may transmit power to the panel light fixture 800 via the input line 10.

Figure 9:
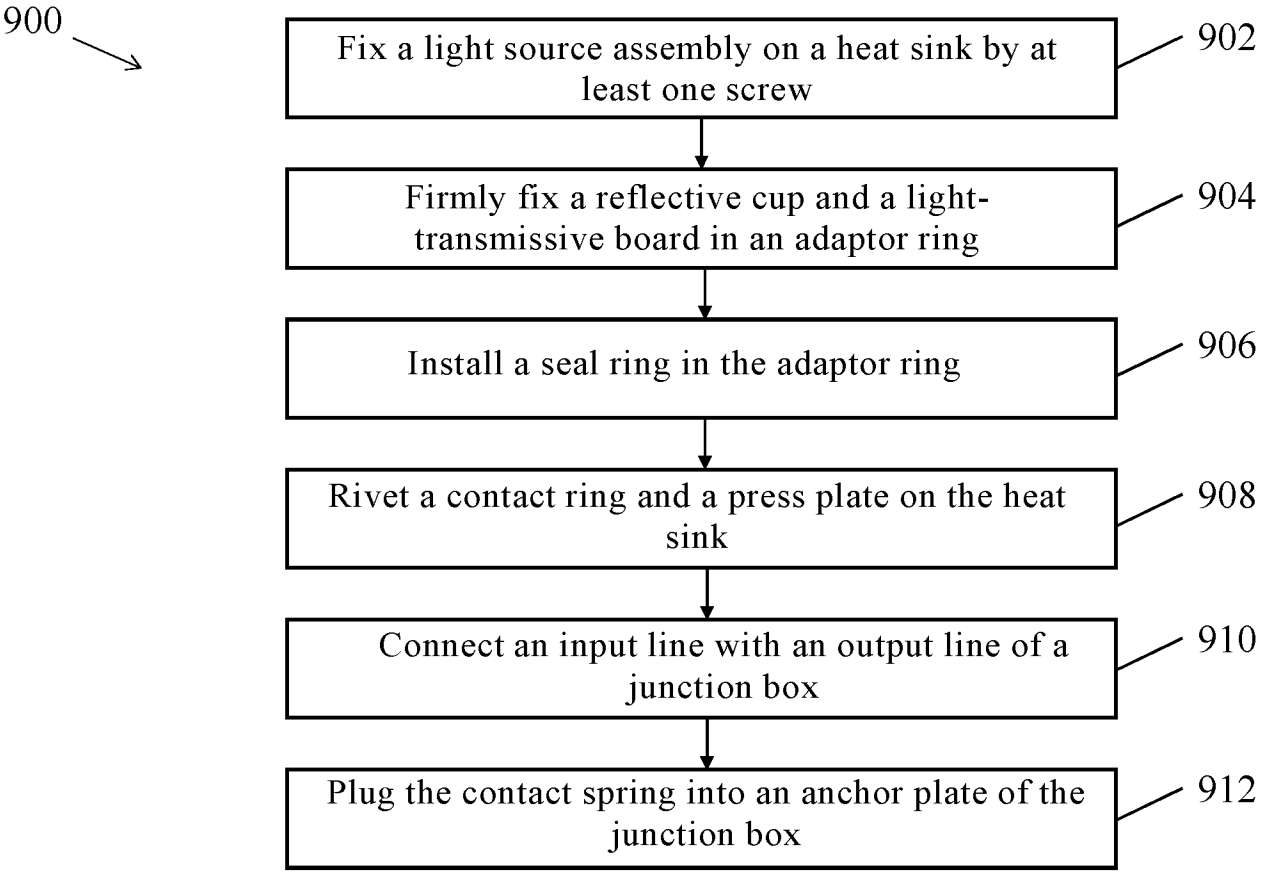
FIG. 9 is a flowchart illustrating a process of forming the pane light device in accordance with some embodiments.

According to some embodiments, the process of installation of the panel light fixture (e.g. 100) comprises the following steps. FIG. 9 is a flowchart illustrating a process of forming the pane light device in accordance with some embodiments. In step 902, the light source assembly 4 is fixed on the heat sink 5 by at least one screw. In step 904, the reflective cup 3 and the light-transmissive board 2 are firmly fixed in the adaptor ring 1 by using the three screws of the heat sink 5. In step 906, the seal ring 13 is installed in the adaptor ring 1 to improve the water resistivity of the panel light fixture. In step 908, the contact spring 6 and the press plate 8 are riveted on the heat sink 5 by the rivet 9. In step 910, the input line 10 is connected with the output line of the junction box. In step 912, the contact spring 6 is plugged into the anchor plate 7 of the junction box to finish the installation of the panel light fixture. It is noted that, in step 912, the anchor plate 7 has been installed on the junction box before the contact spring 6 is plugged into the anchor plate 7.

Briefly, the present invention provides a panel light fixture adaptive to various sizes of junction boxes by using an anchor plate having a connection hole and a plurality of mounting holes. The anchor plate is installed on the junction box through a portion of the mounting holes, and a contact spring on the panel light fixture is plugged into connection hole of the anchor plate. Accordingly, the adaptability of the panel light fixture is improved.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A panel light fixture, comprising:

a light source assembly;

a heat sink, attached to the light source assembly;

an adaptor ring, arranged to accommodate the light source assembly and the heat sink;

an anchor plate, having a connection hole and a plurality of mounting holes, for mounting with a junction box; and a contact spring, firmly connected to the heat sink, for anchoring the anchor plate through the connection hole;

wherein the junction box is mounted to the anchor plate through the plurality of mounting holes, wherein the plurality of mounting holes are disposed on a first side and a second side of the connection hole respectively, the plurality of mounting holes and the connection hole are aligned to a straight line, and the first side of the connection hole is opposite to the second side of the connection hole, wherein the contact spring comprises: a bottom section, arranged to firmly connect to the heat sink; a bending section, formed on a first end and a second end of the bottom section, wherein the bending section is arranged to bend upward from the first end and the second end of the bottom section; and a guiding section, formed on a first end of the bending section, wherein a second end of the bending section is connected to the bottom section, and the guiding section is arranged to be tilted inward.

2. The panel light fixture of claim 1, further comprising:
a light-transmissive board; and
a reflective cup;
wherein the light-transmissive board, the reflective cup, the light source assembly, and the heat sink are orderly accommodated in the adaptor ring from a lower portion of the adaptor ring to an upper portion of the adaptor ring.

3. The panel light fixture of claim 2, further comprising:
a seal ring, disposed between the adaptor ring and the light-transmissive board.

4. The panel light fixture of claim 3, wherein the seal ring comprises:
a circular and convex supporting rod, disposed on a side of the light-transmissive board, for making the light-transmissive board tightly contact with the seal ring.

5. The panel light fixture of claim 1, wherein the adaptor ring is configured to have a central opening.

6. The panel light fixture of claim 1, further comprising:
a press plate, disposed on the bottom section of the contact spring, the press plate firmly connected to the bottom section of the contact spring and the heat sink.

7. The panel light fixture of claim 6, further comprising:
a fastener, arranged to fix the press plate and the contact spring on a surface of the first side of the heat sink.

8. The panel light fixture of claim 1, further comprising:
an input line, having a first end electrically connected to the light source assembly, and a second end penetrated the heat sink; and
a fixing clamp, arranged to fix the input line.

9. The panel light fixture of claim 1, further comprising:
a Mylar tape, disposed on the light source assembly.

10. The panel light fixture of claim 1, wherein the adaptor ring comprises:
an annular groove, formed inside the adaptor ring; and
the panel light fixture further comprises:
a foaming material, formed in the annular groove.

11. A panel light fixture, comprising:
an anchor plate, having a connection hole and a plurality of mounting holes;
a junction box, mounting to the anchor plate through the plurality of mounting holes;
a light source assembly, arranged to emit optical light;
a heat sink, attached to the light source assembly; and
a contact spring, firmly connected to the heat sink, for anchoring the anchor plate through the connection hole, wherein the contact spring comprises:
a bottom section, arranged to firmly connect to the heat sink;
a bending section, formed on a first end and a second end of the bottom section, wherein the bending section is arranged to bend upward from the first end and the second end of the bottom section; and
a guiding section, formed on a first end of the bending section, wherein a second end of the bending section is connected to the bottom section, and the guiding section is arranged to be tilted inward.

12. The panel light fixture of claim 11, wherein the junction box is mounted to a portion of holes in the plurality of mounting holes of the anchor plate for providing a supply power for the light source assembly according to a size of the junction box.

13. The panel light fixture of claim 12, wherein the portion of holes are symmetrical holes with respect to the mounting hole.

14. The panel light fixture of claim 11, further comprising:
a reflective cup, arranged to reflect the optical light;
a light-transmissive board, arranged to pass the optical light; and
an adaptor ring, arranged to orderly accommodate the light-transmissive board, the reflective cup, the light source assembly, and the heat sink from a lower portion of the adaptor ring to an upper portion of the adaptor ring.

15. The panel light fixture of claim 11, wherein the plurality of mounting holes are disposed on a first side and a second side of the connection hole respectively, the plurality of mounting holes and the connection hole are aligned to a straight line, and the first side of the connection hole is opposite to the second side of the connection hole.

16. The panel light fixture of claim 11, wherein the bending section and the guiding section are arranged to mount into the connection hole of the anchor plate.

17. The panel light fixture of claim 11, further comprising:
a press plate, disposed on the bottom section of the contact spring, the press plate firmly connected to the bottom section of the contact spring and the heat sink to enhance a strength the contact spring.

* * * * *